US011538320B2

(12) United States Patent
Sprakel

(10) Patent No.: US 11,538,320 B2
(45) Date of Patent: Dec. 27, 2022

(54) PARKING SPACE INFORMATION SYSTEM

(71) Applicant: FOGTEC Brandschutz GmbH, Cologne (DE)

(72) Inventor: Dirk K. Sprakel, Cologne (DE)

(73) Assignee: FOGTEC Brandschutz GmbH, Cologne (DE)

( * ) Notice: Subject to any disclaimer, the term of this patent is extended or adjusted under 35 U.S.C. 154(b) by 0 days.

(21) Appl. No.: 17/771,355

(22) PCT Filed: Oct. 16, 2020

(86) PCT No.: PCT/EP2020/079162

§ 371 (c)(1),
(2) Date: Apr. 22, 2022

(87) PCT Pub. No.: WO2021/078638

PCT Pub. Date: Apr. 29, 2021

(65) Prior Publication Data

US 2022/0366769 A1 Nov. 17, 2022

(30) Foreign Application Priority Data

Oct. 25, 2019 (DE) ..... 10 2019 128 865.7

(51) Int. Cl.

| | |
|---|---|
| ***G08B 21/00*** | (2006.01) |
| ***G08B 17/06*** | (2006.01) |
| ***G08G 1/00*** | (2006.01) |

(52) U.S. Cl.
CPC ..... *G08B 17/06* (2013.01); *G08G 1/205* (2013.01)

(58) Field of Classification Search
CPC ..... G08B 17/06; G08G 1/205
USPC ..... 340/939
See application file for complete search history.

(56) References Cited

U.S. PATENT DOCUMENTS

| | | | | |
|---|---|---|---|---|
| 6,636,145 | B1 | 10/2003 | Murakami et al. | |
| 10,311,731 | B1 | 6/2019 | Li et al. | |
| 2011/0068953 | A1* | 3/2011 | Toledo | B62D 15/027 340/932.2 |
| 2016/0370495 | A1* | 12/2016 | Larcher | G01V 9/00 |
| 2017/0004709 | A1* | 1/2017 | Nordbruch | G08G 1/04 |
| 2017/0032583 | A1* | 2/2017 | Moran | G08G 1/0116 |

FOREIGN PATENT DOCUMENTS

| | | | | |
|---|---|---|---|---|
| DE | 102016202044 | A1 * | 8/2017 | G08G 1/141 |
| EP | 1067481 | A2 | 1/2001 | |
| EP | 2503529 | A1 | 9/2012 | |
| EP | 3355249 | A1 | 8/2018 | |
| JP | 2016103926 | A | 6/2016 | |

* cited by examiner

*Primary Examiner* — Mark S Rushing
(74) *Attorney, Agent, or Firm* — The Webb Law Firm

(57) ABSTRACT

Provided is a parking space information system including at least one sensor set up for detecting vehicle data of vehicles in the parking space, an evaluation device set up for receiving the detected vehicle data and for determining a drive type of the vehicle depending on the detected vehicle data, and set up for outputting the determined drive type.

13 Claims, 5 Drawing Sheets

PARKING SPACE INFORMATION SYSTEM

CROSS-REFERENCE TO RELATED APPLICATIONS

This application is the United States national phase of International Application No. PCT/EP2020/079162 filed Oct. 16, 2020, and claims priority to German Patent Application No. 10 2019 128 865.7 filed Oct. 25, 2019, the disclosures of which are hereby incorporated by reference in their entirety.

BACKGROUND OF THE INVENTION

Field of the Invention

The subject matter relates to a parking space information system, particularly in the field of firefighting.

Description of Related Art

Firefighting systems for parking space management systems are well known and often required by law. Especially parking garages or underground parking spaces are exposed to considerable fire risks due to their structural density and proximity of vehicles to each other and the associated high fire loads. Until now, a fire in a parking space was always assumed to involve the burning of the fossil fuels of the vehicle drives. This was "favorable" in that the fire department always knew which materials were on fire and could initiate firefighting tailored to them.

Due to the diversification of the different drive types, caused by the energy transition, in case of a fire in a parking garage or an underground parking space, it is no longer clear before firefighting what the cause of the fire is and what the fire load is. So-called new energy carriers (NEC) are vehicles with alternative drive systems to internal combustion engines. This starts with gas vehicles, continues with hybrid-electric vehicles and plug-in hybrid-electric vehicles, and ends with purely electric vehicles and also vehicles powered by fuel cells (possibly using hydrogen). Especially battery-based vehicles with hybrid drive (hybrid electric vehicle (HEV)), plug-in hybrid drives (plug in electric vehicle (PEV)) and pure battery drives (battery electric vehicle (BEV)) always include a battery for energy storage. Batteries known to date for automotive use are lithium-ion batteries, which pose a significant fire risk and are difficult to extinguish in the event of a fire, requiring appropriate measures. These new vehicles pose previously unknown problems for firefighters. For example, in the case of gas or hydrogen-powered vehicles, the heat generated by the fire load can collect under the ceiling of the parking garage or escape in other directions. Therefore, such fires are also difficult to control. If approached, there may be a danger of explosion. In any case, a completely different attack strategy for the fire department and, if necessary, a stationary firefighting system (FFS) may be required than is the case with "conventional" drives.

SUMMARY OF THE INVENTION

Therefore, the subject matter was based on the object of providing a parking space information system in which fire loads are known in advance of a fire.

This object is solved by a parking space information system as described herein.

Parking spaces are usually managed. For the management it is necessary to detect vehicles entering and leaving the parking space. The vehicles usually enter the parking space through entrances or entries with barriers or being otherwise restricted and leave the parking space via corresponding exits. During entry and exit, vehicle features can be detected by a corresponding sensor.

For example, a sensor may be a camera or a radio receiver. When using a camera, for example, the license plate of the vehicle can be automatically detected and read. Also, a sensor can have an image recognition system that recognizes the type of passenger car by its shape and, if applicable, type markings. Even if this is not always unambiguous, at least vehicle types could be excluded as not relevant. For example, when using a radio receiver, it is possible to receive vehicle data emitted by the vehicle, such as a vehicle identification number (VIN). It is also possible to activate and read a passive transponder within a vehicle by a sensor. In this case, the sensor can also read out a vehicle identification number, for example. Other attributes or features of a vehicle can be detected accordingly by a sensor. The sensor is therefore arranged to obtain vehicle data from vehicles in the parking space.

In addition to obtaining vehicle data at the entrance and/or exit, it is alternatively or cumulatively also possible to obtain vehicle data directly at the parking lot. Up to now, presence sensors have often been arranged at parking lots to report the presence of a vehicle in the parking lot. These presence sensors could, for example, be supplemented by sensors suitable for recording vehicle data. Such sensors can, for example, be sensors such as those used for entry and exit and described above.

Although a sensor arranged at the parking lot has the disadvantage that the number of sensors within the parking space is considerable, in particular corresponding to the number of parking lots, on the other hand it is thereby possible to be able to assign a detected vehicle type to a specific parking lot or at least to a specific area within the parking space.

It is also possible for a respective sensor, as described above, to be assigned to a plurality of respective parking lots. For example, one sensor may be arranged at each parking deck to detect all vehicles within the respective parking deck. A sensor can also be arranged along a row of parking lots or in some other spatially determined area in respectively to detect the vehicle data of all vehicles arranged in this area. In such a case, the assignment of vehicle data to parking lots is no longer completely spatially precise, but a certain degree of spatial blurring is acceptable and still leads to the desired effects.

After the vehicle data have been acquired, they can be received by an evaluation device. With the aid of the evaluation device, it is possible to determine information about a drive type of the vehicle from the vehicle data. For example, the corresponding vehicle type, in particular the corresponding drive type, can be stored in a database for each vehicle.

In the broadest sense, a drive type can relate to both the powertrain and the storage technology for storing the drive energy. A powertrain may be based on an internal combustion engine or an electric motor. A storage technology may involve a liquid fuel tank, a gas tank, or a battery. A battery may include different technologies, such as Li-ion batteries, lead-acid batteries, lithium polymer batteries, etc. For simplicity, only drive type is referred to below.

After the drive type has been determined, it can be output and further processed. In particular, the drive type is further processed in a fire alarm control center and, in the event of a fire or other operation by the fire department, information about the drive types of the vehicles within the parking space can be output, preferably in a location-resolved manner, in particular assigned to each individual parking lot. This facilitates the work of the fire department, which has to fight different fire loads. Also, the information on the drive type can be sent to a "simple computer" or a processing system, e.g., the building control system. These, in turn, could send signals to the fire alarm control panel, fire department, janitor, security guard, etc. The term fire alarm control panel is used for the following text as a synonym for all different evaluation units.

If one sensor is arranged at the entrance and one at the exit of the parking space respectively, it is possible to determine a drive type of at least one vehicle that is currently in the parking space by means of the evaluation unit. Such a drive type can be output. Preferably, the evaluation device always maintains a list of the drive types of all vehicles present in the parking space and outputs it as required. When a vehicle enters, this vehicle is added to the list and when a vehicle leaves, the corresponding vehicle is removed from the list. The assignment to the parking lot can be made for the entire parking space or spatially limited areas, for example parking decks of the parking space.

According to an embodiment, it is proposed that the evaluation device outputs the detected vehicle data and/or the detected drive types each assigned to a parking lot.

As already explained, the parking space may be divided into dedicated parking lots. It is therefore proposed that the parking space has at least two spatially defined parking lots. A dedicated sensor can be assigned to each of these parking lots. Furthermore, it is possible that several parking lots are combined into a respective group and that a respective sensor is assigned to each of the groups of parking lots. A group of parking lots can be a parking deck, for example. This makes it possible to determine, parking lot-specific (location-specific) or with a fuzziness related to the respective group of parking lots, the drive types of the vehicles parked in these parking lots and to output them as required.

As soon as a signal (e.g. a fire alarm signal or a pre-alarm) is output, information about the determined drive types can be output together with this signal. The determined drive types can be made available to a fire alarm control panel, as already explained at the beginning. As soon as the signal is output, it can be enriched with information about the drive types, which makes it much easier for the fire department to subsequently fight the fire.

As explained earlier, the output of the drive type can also be parking lot specific. It is therefore proposed that a fire alarm control center outputs the determined drive types in the event of a signal, in particular that the fire alarm control center outputs the determined drive types assigned to a respective parking lot. Thus, when fighting a fire, attention can be paid to the respective drive type and thus also the storage technology of a vehicle to be expected at a respective parking lot and the corresponding fire-fighting strategy can be adapted.

A smoke detector or other fire detector can also be used. The vehicle may also have a fire sensor. The vehicle may wirelessly output a corresponding signal when a fire is detected. The vehicle may collect location data and output with it. The location data may be acquired by GPS or known interior location detections in the vehicle.

According to an embodiment, at least one sensor is arranged at an entrance and at least one sensor is arranged at an exit of the parking space. This makes it possible to determine the vehicles entering and leaving the parking space as well as their vehicle data via the sensor and to store the vehicles located in the parking space together with their drive types. The evaluation device can output the detected and determined drive types continuously, at intervals or on request, for example by the fire alarm control center. In particular, the evaluation device can output all determined drive types of the vehicles present in the parking space depending on the detected vehicle data at the entrance and the exit.

According to an embodiment, it is proposed that at least one temperature sensor is arranged directly at a parking lot, in particular in the floor of the parking lot.

Depending on the drive type, the temperature slope of a vehicle may be different. Both when driving in and parking the vehicle, i.e. the cooling process after a journey, and when a fire occurs, i.e. the initial heating process leading up to a fire, the temperature slope is strongly dependent on the drive type.

In addition, the position of so-called hotspots, i.e. areas in which the vehicle heats up in particular, in the area of the underbody of vehicles with different drive types also varies significantly.

For example, with an internal combustion engine, an increased temperature is to be expected in the front area of the vehicle at the start of the parking process, as this is where the internal combustion engine is located. The temperature usually decreases linearly or digressively, depending on whether the engine's radiator is trailing or not. After cooling, the temperature remains low. The hotspot of the temperature slope is usually in the area of the engine block or the tank of the vehicle.

In the case of a battery-powered vehicle with a fuel cell, a low temperature in the area of the front of the vehicle can be expected at the beginning of the parking process, since an electric motor heats up less than an internal combustion engine. The temperature generally decreases linearly. After cooling, the temperature remains low. In the event of a fire, however, and especially before a fire starts, the battery will generally heat up. This heating process takes place over a few minutes, and is in particular considerably longer than in the case of a fossil fuel fire. However, once a so-called "tripping point" is reached, the temperature rises rapidly, culminating in the fire or explosion of the battery. The hotspot of the temperature slope is usually in the center of the vehicle, as this is where the battery is usually located.

In the case of a hydrogen-powered vehicle, a low temperature in the area of the front of the vehicle can be expected at the beginning of the parking process, since an electric motor heats up less than an internal combustion engine. The temperature generally decreases linearly. After cooling, the temperature remains low. In the event of a fire, the temperature rise will generally be even faster than for a vehicle with an internal combustion engine, since the hydrogen will react immediately and explode. The hotspot of the temperature slope is usually in the area of the vehicle's tank.

This circumstance is exploited by providing a temperature sensor that can be attached to the floor of a parking lot. Via the temperature sensor, which can preferably record a temperature profile not only at points but in particular along a line and/or over an area, the temperature at the underbody of a vehicle can be recorded over the course of the parking period.

The drive types mentioned are purely exemplary. There are also, for example, gas-powered vehicles as well as hydrogen vehicles with internal combustion engines, which also have typical temperature profiles.

A temperature slope can be both temporal and spatial. A temporal temperature slope can represent temperature over time. A spatial temperature slope can represent, for example, a temperature along at least one extension axis (one-dimensional) of the temperature sensor, in particular in along two axes (two-dimensional).

This and further information about the temperature slope can be stored in the evaluation unit in order to add information to the signal, from which a probable fire load results. For example, the signal can contain information about a drive type of the vehicle at a respective parking lot.

A temperature sensor can be exclusively assigned to a parking lot. In this case, the evaluation unit can determine not only the temperature slope but also the location of the temperature slope, in particular the parking lot. Thus, information about the parking lot itself, that is, spatial information about the parking lot or a designation of the parking lot, can be added to the signal.

According to an embodiment, it is proposed that the temperature sensor is an optical fiber line. With the aid of such an optical fiber line, temperature sensing can be performed, in particular, in a small-scale manner at the bottom of the parking lot. A fiber line can have a longitudinal extent and a temperature profile can be determined locally resolved along the fiber line.

The fiber line is in particular a fiber optic line, in particular a fiber optic fire alarm cable. Such fiber optic fire detection cables are already known and are used, for example, in the ceiling area of tunnels in order to be able to perform temperature sensing over long distances.

However, the temperature sensor can also be an electrical sensor, for example a sensor based on a resistance wire. Such a sensor can be divided into sections, which can be evaluated individually, for spatial resolution. A temperature sensor based on an electrical resistor, for example an NTC resistor, is also conceivable.

To prevent the temperature sensor from being damaged by vehicles driving over it, it is suggested that the temperature sensor is integrated into the floor of the parking lot. During construction of the parking lot, the temperature sensor can be embedded, for example, before the top surface layer is applied. For a subsequent installation, it is possible, for example, that the top surface layer is slit open, the temperature sensor is inserted and then the slit is sealed, for example with a bitumen.

As already explained at the beginning, the evaluation unit can store which temperature slope is characteristic for which vehicle type, in particular which drive type. Thus, different characterizing temperature slopes can be stored in the evaluation unit for one vehicle type and/or for one drive type respectively. Thus, a cluster of typical temperature slopes can be stored in the evaluation unit for each drive type.

The determined temperature slope is compared with the stored temperature slopes. In particular, this can be done by cross-correlating the acquired temperature slope with the stored temperature slope, both in terms of time and spatial resolution. One such method is, for example, an SSD method. It can be determined with which of the stored temperature slopes the detected temperature slope is most similar. Also, for example, a sum of all deviations of the acquired temperature slope with all temperature slopes belonging to a cluster can be formed and the absolute value of the sum or a normalized value of the sum for all clusters is compared with each other. The smallest amount of deviation can be used to determine the cluster that is most likely for the acquired temperature slope. Depending on the comparison, the evaluation unit can determine a drive type of the vehicle parked in the parking lot. In any case, a very high temperature and thus a fire can always be detected. Even if no knowledge about the type of the vehicle is available or can be recognized from the temperature slope. Thus, the system could assign the fire to a location even without evaluating the specifics of a temperature slope.

In addition, if location sensors are available and the system knows the specific type of vehicle at the specific location, unusual temperature slopes can be recognized as such more quickly. Thus, the system would wait for an E-slope in the case of an E-car, etc.

It can often be relevant which vehicles are next to each other. It can lead to combinations of drive types in NECs that pose significant fire risks. If two internal combustion engines stand side by side, the fire risk is conventional. However, if a fuel cell vehicle is next to a battery vehicle, for example, a defect in one vehicle can cause a chain reaction on the other vehicle. Therefore, it may be relevant to know which drive types are adjacent to each other. Therefore, it is proposed that the evaluation device spatially assigns the determined drive types of vehicles in parking lots that are different from each other, and that the fire alarm control panel outputs signals that are different from each other depending on the spatial assignment of two drive types.

For example, if an internal combustion engine is parked next to a battery-powered vehicle, it is possible for the fire alarm control panel to output a signal that provides a corresponding indication. If, for example, the vehicle with the combustion engine is then burning, extinguishing with water may not be indicated, as this could trigger a chain reaction of the lithium of the battery storage of the vehicle parked next to it. The interdependencies of different drive types and their fire loads with each other cannot yet be conclusively described today, since the various drive types are in rapid development and a wide variety of energy sources will be used in the future. Thus, the use of extinguishing media may depend on the drive type, e.g. water, foam, gas, etc.

BRIEF DESCRIPTION OF THE DRAWINGS

In the following, the subject matter is explained in more detail with reference to a drawing. In the drawing show.

DESCRIPTION OF THE INVENTION

Figure 1:
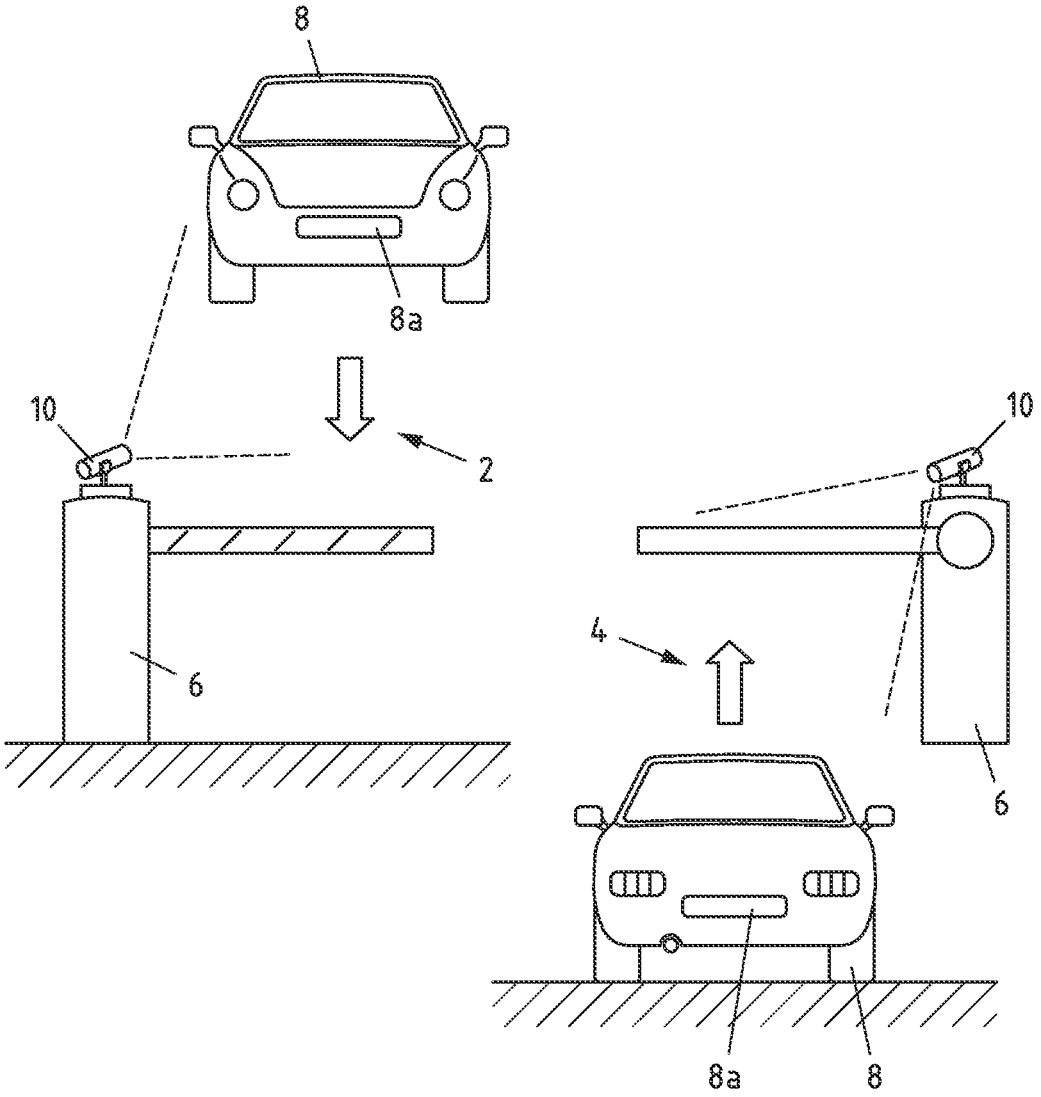
FIG. 1 a schematic view of an entrance and exit of a parking space.

FIG. 1 shows an entrance 2 as well as an exit 4 of a parking space. In the area of the entrance 2 as well as in the area of the exit 4, a barrier 6 can optionally be provided respectively. If a vehicle 8 wants to enter the parking space, it must pass through the barrier 6 at the entrance 2. If a vehicle 8 wants to leave the parking space, it must pass through barrier 6 at exit 4. A sensor 10 can be provided at both the entrance 2 and the exit 4. In FIG. 1, the sensor 10 is a camera.

When the vehicle 8 passes the camera 10 at the entrance 2, the camera 10 captures an image of the vehicle 8 including the license plate 8*a*. The capture of the license plate 8*a* is conventionally known.

The same happens when a vehicle 8 passes the sensor 10 at the exit 4. Again, the license plate 8*a* is read out. The license plates read out by the sensors 10 can be made available as vehicle data to an evaluation unit, as described below.

Figure 2:
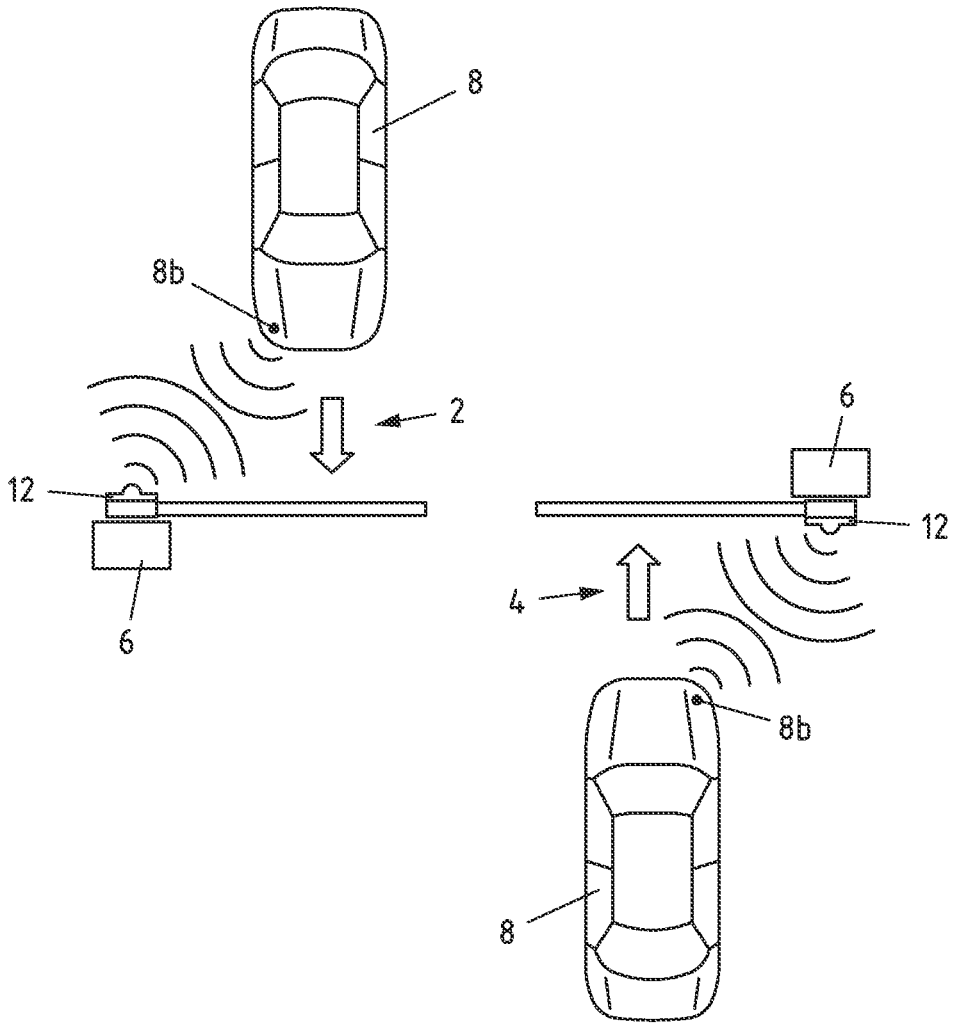
FIG. 2 a schematic top view of an entrance and exit of a parking space.

It is also possible for radio-based acquisition of vehicle data to take place. This is shown in FIG. 2. Here, too, vehicles 8 are shown at entry 2 and exit 4. In the area of the entrance 2 as well as the exit 4, in particular in the area of the barriers 6, a radio sensor 12, for example a near field sensor, an RFID sensor, an NFC sensor, a Bluetooth sensor, a WLAN sensor or the like can be arranged. For example, a transponder 8*b* may be provided within a vehicle. It is also possible that a Bluetooth token is provided. The transponder 8*b* or the Bluetooth token is a wirelessly readable information carrier. The information carrier contains, for example, a vehicle identification number or directly information about a drive type of the vehicle 8. If the barrier 6 is passed, the transponder 8*b* is read by the radio sensor 12 and the vehicle data is made available to the evaluation device.

Figure 3:
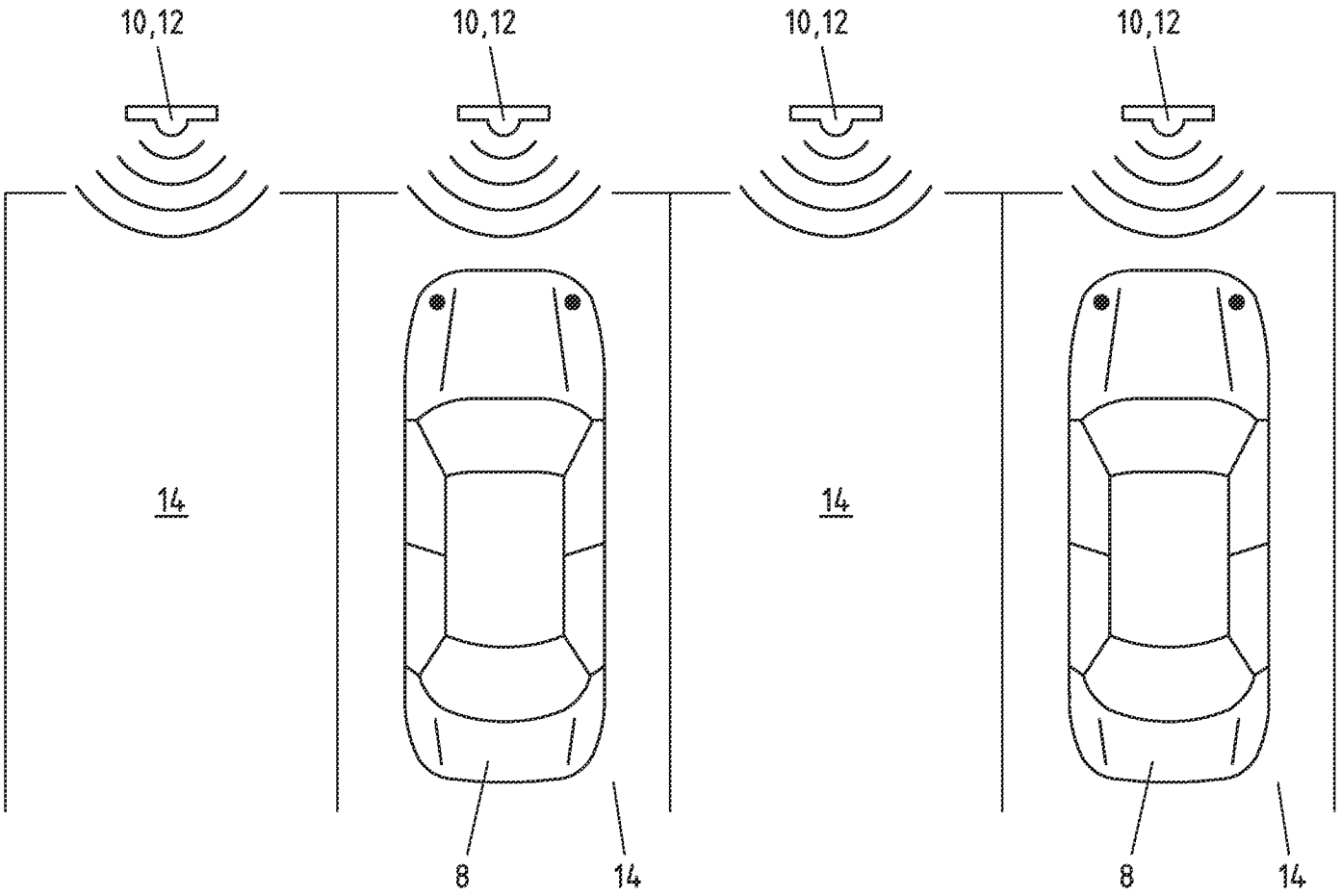
FIG. 3 a schematic top view of a plurality of parking lots.

It is also possible for one sensor 10, 12 to be arranged at each parking lot. This is shown in FIG. 3. Different parking lots 14 can each be equipped with a sensor 10, 12. The reading of the vehicle data of the vehicles 8 at the parking lots 14 is carried out according to the above explanations. A sensor 10 and/or a sensor 12 may be provided. With the aid of this information, information about the vehicle 8 in the parking lot 14 can be determined for each parking lot 14 and made available to the evaluation device.

Figure 4:
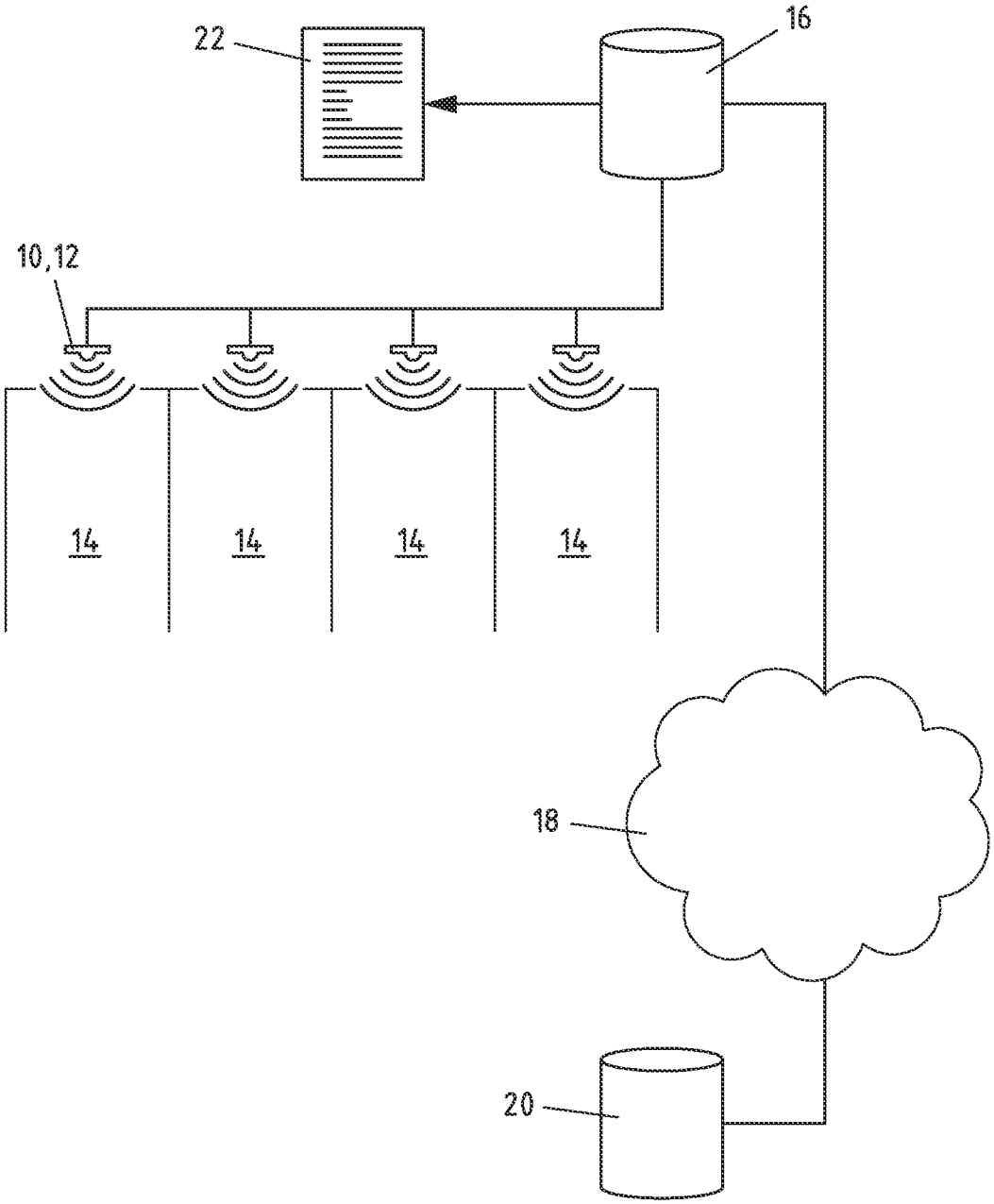
FIG. 4 a schematic representation of a system according to an embodiment.

FIG. 4 shows the connection of the sensors 10, 12 at the parking lots 14 with an evaluation device 16. A corresponding connection can also be made for the sensors 10, 12 according to FIGS. 1 and 2. Via a wired or wireless connection, the vehicle data read out by the sensors 10, 12 are made available to the evaluation device. With the aid of this vehicle data, the evaluation device 16 queries an external database 20 via a wide area network 18, for example, and thus determines the drive types of the corresponding vehicles 8 on the basis of the vehicle data. If the drive type is read out directly with the aid of the sensors 10, 12, this step can be omitted.

In the evaluation device 16, it is thus optionally stored which vehicles 8 with which drive types are currently parked in the parking space. A list 22 can store general information about all vehicles 8 with their drive types, or specific information for each parking lot 14.

In the event of a fire or other alarm, particularly in the event of a fire alarm signal or pre-alarm, the evaluation device 16 can provide the information on the drive types to a fire alarm control center 22.

Figure 5:
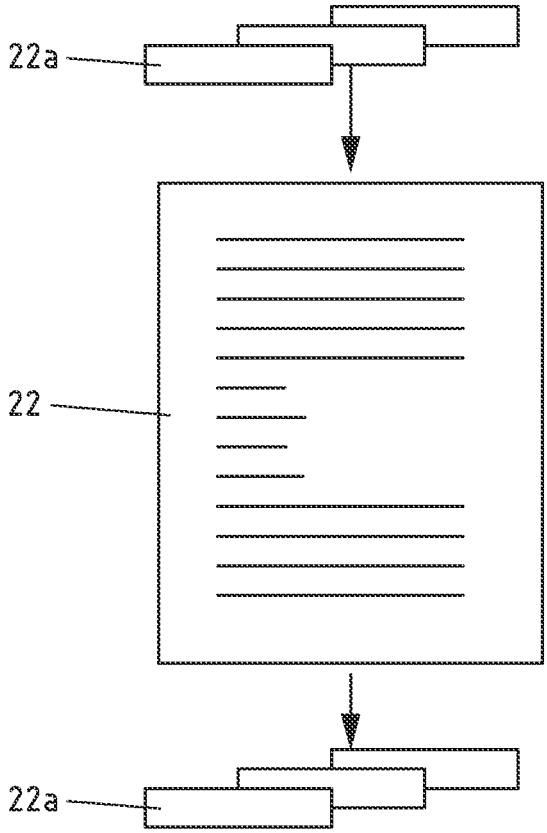
FIG. 5 a schematic representation of a list of an evaluation device.

A corresponding list 22 may be maintained in the evaluation device 16 as shown in FIG. 5. Each time a vehicle 8 or the vehicle data is detected by a sensor 10 when a vehicle 2 enters the parking space through the entrance or parks at a parking space 14, information 22*a* on a drive type is added to the list 22. The information 22*a* may additionally include information about a parking lot 14, if any.

Each time a vehicle 8 leaves a parking space 14 or exits the parking space via exit 4, the corresponding information 22*a* of that vehicle is removed from the list 22. Thus, the list 22 always contains the information of all the drive types of the vehicles 8 that are in the parking space. Using this information, a fire department can select the appropriate firefighting strategies in the event of a fire. The information could also be used to provide a firefighting system with information about where and what is burning so that it is activated at the correct location. The extinguishing agent could also be selected accordingly.

The invention claimed is:

1. A parking space information system comprising fire alarm control center;

at least one sensor arranged to detect vehicle data from vehicles in the parking space, an evaluation device arranged to receive the detected vehicle data and to determine a drive type of the vehicle as a function of the detected vehicle data, and arranged for outputting the determined drive type, wherein the fire alarm control center is arranged for processing the output determined drive types.

2. The parking space information system according to claim 1, wherein the evaluation device outputs the drive types, determined as a function of the detected vehicle data, of at least one vehicle currently present in the parking space.

3. The parking space information system according to claim 1, wherein the evaluation device outputs the detected vehicle data and/or the determined drive types assigned to a respective parking space.

4. The parking space information system according to claim 1, wherein the parking space has at least two spatially defined parking lots.

5. The parking space information system according to claim 1, wherein the fire alarm control center outputs the determined drive types in the event of an active fire alarm signal.

6. The parking space information system according to claim 1, wherein the fire alarm control center outputs the determined drive types in the event of a fire alarm signal, in particular in that the fire alarm control center outputs the determined drive types assigned to a respective parking space.

7. The parking space information system according to claim 1, wherein at least one sensor is arranged at an entrance and at least one sensor is arranged at an exit of the parking space, and in that the evaluation device outputs all determined drive types of the vehicles staying in the parking space as a function of the detected vehicle data at the entrance and at the exit.

8. The parking space information system according to claim 1, wherein at least one sensor is arranged directly at a parking lot, in particular integrated in the floor of the parking lot.

9. The parking space information system according to claim 1, wherein at least one sensor is a fiber line, in particular a fiber optic line, in particular in that the fiber line is a fiber optic fire alarm cable.

10. The parking space information system according to claim 1, wherein the evaluation device uses the sensor to evaluate at least one temperature profile at the parking lot, and the evaluation device compares the detected temperature profile with stored temperature profiles and, depending on the comparison, determines a drive type of a vehicle parked in the parking lot.

11. The parking space information system according to claim 1, wherein the evaluation device evaluates a temporally first temperature profile and determines a drive type on the basis of the evaluation, and subsequently evaluates a temporally second temperature profile as a function of the determined drive type in order to output a fire alarm signal.

12. The parking space information system according to claim 1, wherein at least one sensor is an image sensor and/or a near-field sensor.

13. The parking space information system according to claim 1, wherein the evaluation device spatially associates the determined drive types of vehicles in parking lots which are different from one another, and in that the fire alarm control center outputs control signals which are different from one another depending on the spatial association of two drive types.

* * * * *